US009441926B1

(12) United States Patent
Bond et al.

(10) Patent No.: US 9,441,926 B1
(45) Date of Patent: Sep. 13, 2016

(54) GOLF COURSE-COMPATIBLE MODIFIED GOLF GAME AND SAFETY EQUIPMENT

(71) Applicants: Victor Bond, Monterey, CA (US); Judith Kunzlé, Monterey, CA (US)

(72) Inventors: Victor Bond, Monterey, CA (US); Judith Kunzlé, Monterey, CA (US)

(73) Assignees: Victor Bond, Pebble Beach, CA (US); Judith Kunzle, Pebble Beach, CA (US)

( * ) Notice: Subject to any disclaimer, the term of this patent is extended or adjusted under 35 U.S.C. 154(b) by 0 days.

(21) Appl. No.: 14/874,331

(22) Filed: Oct. 2, 2015

Related U.S. Application Data

(60) Provisional application No. 62/059,131, filed on Oct. 2, 2014.

(51) Int. Cl.
*A63B 67/02* (2006.01)
*A63B 69/36* (2006.01)
*F42B 6/08* (2006.01)

(52) U.S. Cl.
CPC *F42B 6/08* (2013.01); *A63B 67/02* (2013.01)

(58) Field of Classification Search
USPC ..... 473/131, 470, 577, 581, 528, 409; 124/23.1, 24.1, 44.5
See application file for complete search history.

(56) References Cited

U.S. PATENT DOCUMENTS

| | | | | |
|---|---|---|---|---|
| 6,142,895 | A * | 11/2000 | Jason | F42B 12/40 473/577 |
| 8,505,524 | B2 * | 8/2013 | Lyon | F41B 5/14 124/23.1 |
| 2008/0010842 | A1 * | 1/2008 | Jones | F41G 1/35 33/265 |
| 2008/0096702 | A1 * | 4/2008 | Martin | F41J 3/0004 473/581 |
| 2013/0123051 | A1 * | 5/2013 | Pierce | F42B 6/08 473/577 |
| 2014/0256479 | A1 * | 9/2014 | Bynum, Jr. | F42B 6/08 473/470 |

* cited by examiner

*Primary Examiner* — Nini Legesse

(57) ABSTRACT

An aerodynamic safety arrow for a modified golf game to be played with a bow upon a conventional golf course includes a shaft, wherein a spine associated with the shaft is appropriate for a pull weight associated with the bow, and a safety arrowhead disposed upon the shaft, wherein the safety arrowhead comprises a blunt front-end region and a concave rear-end region, wherein the blunt front-end region comprises a radius of curvature less than about 20 mm, and wherein the concave rear-end region is coupled to the shaft, wherein the shaft and safety arrow head weigh less than about 45 g.

21 Claims, 9 Drawing Sheets

GOLF COURSE-COMPATIBLE MODIFIED GOLF GAME AND SAFETY EQUIPMENT

CROSS-REFERENCES TO RELATED APPLICATIONS

The present application is a non-provisional of and claims priority to the following provisional patent applications: App No. 62/059,131 filed Oct. 2, 2014. This application is incorporated by reference herein, for all purposes.

BACKGROUND OF THE INVENTION

The present invention relates to golf. More specifically, the present invention relates to apparatus and methods for playing golf that increase player participation and are accepted for play by golf courses.

Prior attempts to develop a golf-type game with a bow and arrow-type mechanism were previously proposed, without much commercial success. For example, one such attempt includes use of a toy-type bow with attached arrow, and a special, detachable golf ball mounted upon the end of the arrow, as disclosed in U.S. Pat. No. 8,505,524 B2 issued Aug. 13, 2013. In such a device, after the user draws and releases the arrow, the special ball detaches from the tip of the arrow. The special ball flies down the course while the arrow remains attached to the string. One drawback to this approach is that non-standard bows are required to be used—a special bow with an arrow that does not separate from the string. Such a solution seems to have a high barrier of acceptance for players, for example, as it requires the player to purchase a special bow (potentially hundreds of dollars) that could only be used to play the game. Further, the bow would seem more like a toy to players, especially to those skilled in archery. Another drawback is that, similar to conventional golf, the balls can roll into the brush and get lost. Because the balls are especially made to fit on the end of the toy arrow, unlike conventional golf, it is expected that players will hunt for their special balls, rather than drop a new ball. This makes the round of golf last longer, and reduces the number of paying golfers a golf course can push through in a day.

Other attempts to develop a golf-type game using a bow and special arrows have been proposed, without much commercial success. For example, as disclosed in U.S. Pat. No. 4,471,962 issued Sep. 18, 1984, the user uses a special multi-pointed arrows for each shot. When landing on the ground with a small angle, the sharp multi-pointed arrows are designed to catch ahold of the ground instead of skipping along the ground. One drawback to this solution is that this game would be very dangerous to play on any conventional golf course. A misfire or test release of an arrow could easily harm the golfer or other members of the golfer's party. Further, as golf courses typically have parallel holes, any misfire of an arrow could be deadly to a person on an adjacent hold. Such solutions are therefore not believed to be attractive to players or golf courses.

Additional attempts to develop a golf-type game using a non-club launching means have also been proposed, without much commercial success. For example, as disclosed in U.S. Pat. No. 6,749,528 issued Jun. 15, 2004, a rifle-type launcher is used to launch a golf ball down the fairway. Similar to the proposed solutions above, these solutions seem to have high barrier to acceptance for players. For example, it requires the players to purchase a custom rifle (potentially hundreds of dollars) that could only be used to play the game. Another drawback is that the use of a rifle on a golf course may be very disconcerting to other players on the golf course. Such solutions are therefore not believed to be very attractive to players or golf courses.

In an unrelated field to a golf-type game, the inventors are aware of a hobby termed "live action role playing" (LARP) where players dress up as medieval warriors to fight. In such embodiments, the players are required to dress up in approved armor, and are required to have approved weapons, before they can clash. In some scenarios, combat archers are allowed and they can deliberately shoot approved arrows at other players. For safety's sake, the arrows are specifically designed to travel very limited distances, for example, up to about 150 feet. If they were designed to go further distances (via a higher bow pull), if a person were shot at a close distance, the impact force would be very high and potentially lethal. To further limit the distances, the arrowheads are typically not designed to be aerodynamic. Additionally, such arrows typically include wide, heavily cushioned arrow heads, that spread-out the impact force on a victim. Drawbacks to such arrows for use in a golf-type game includes that because the aerodynamics are so poor, the range of such arrows is much too short for practical golf-play. For example, for a 600 yard par 5 hole, a player might have to shoot over such arrows twelve shots on that hole to reach the green. Accordingly, a player would find it too tiring to play a full 18 holes of golf. Further, because the round would take a long time to complete, golf courses would not allow such an arrow to be used, as fewer rounds of golf would be completed per day. Yet another drawback is that because such arrow heads typically include foam cushioning for padding, they are not expected to be very durable.

In light of the above, the inventors believe that a new modified golf game and equipment are desired.

SUMMARY OF THE INVENTION

The present invention relates to golf. More specifically, the present invention relates to apparatus and methods for playing golf that increase player participation and are accepted for play by golf courses.

In various embodiments of the present invention, a modified arrow is disclosed for a modified golf game. Embodiments include highly aerodynamic arrows used in a modified golf game that are safer than golf balls hit on a golf course. In current embodiments, aerodynamic safety arrows will be available from the assignee of the present invention under the trade name GolfAeros™ or Aeros™ Various embodiments of the arrows may include aerodynamic safety arrowheads to be available from the assignee under the tradename AeroHeads™ and arrow shafts to be available from the assignee under the tradename AeroShafts™. In certain configurations, the aerodynamic safety arrowheads may be permanently affixed to the arrow shafts; whereas in other embodiments, the arrowheads may be removably affixed to the arrow shafts, via a screw-type mechanism, magnets, tape, wire, via friction fit, or the like. Such embodiments may enable the pairing of different safety arrowheads (having different characteristics) to a particular arrow shaft.

Multiple embodiments of the aerodynamic safety arrowheads and/or arrow shafts are described herein. Depending upon the specific materials, coloring, lighting, weighting, and the like, of the arrowheads and/or the arrow shafts, the flight characteristics of the aerodynamic arrows may be tuned. It is contemplated that the flight characteristics of the arrows may be adjusted depending upon playing conditions, such as different winds and/or precipitation, time of day lighting; and the like. As examples of the latter, the arrows may include different paint schemes, ribbons, internal lighting, and the like, so as to be visible against different visual backgrounds. In some embodiments, a single type of arrow is suitable for use on bows with different bow pulls, for example one arrow is suitable for bows having a pull within a range of about 25 lbs to about 75 lbs. In other embodiments, one type of arrow may be compatible (e.g. stiffness and length) with bow pulls from about 20 lbs to about 40 lbs; and another arrow may be compatible (e.g. stiffness and length) with bow pulls from about 40 lbs to about 75 lbs, and the like.

In various embodiments of the present invention the described designs of aerodynamic safety arrows travel much farther than what the inventors initially hoped their safety arrows would travel. Additionally, in surprising contrast to conventional arrows that tend to flip or stall-out when shot at long distances, embodiments of the present invention maintain a highly parabolic arc when shot.

The embodiments of the aerodynamic arrows are designed to fly in distances similar to a golf ball on the course, for example, a tee shot may fly over 200 yards. Unlike golf balls, however, the aerodynamic arrows do not hook, do not slice, and are only slightly affected by the wind. The aerodynamic arrows are thus highly controllable and fly in the direction intended by the player, not inadvertently towards other players on a golf course. Additionally, because embodiments of the aerodynamic safety arrow heads are blunt shape, the aerodynamic arrow cannot pierce a person's skin. If the arrow somehow strikes another person on the fairway, in various embodiments, the amount of impact from the arrow will be less than a golf ball hit from the same distance. Accordingly, the modified golf game described herein can be played on a conventional golf course at the same time as conventional golfers, and is actually safer to other golfers. In various embodiments, the arrowheads and arrow shafts are designed to approach or exceed the distance and accuracy of existing target and hunting arrows and arrow systems, but, because they incorporate a safety tip, they will have no more (and possibly much less) impact force than a conventional golf ball. The aerodynamic arrows described herein may also be used for general recreational purposes, outside of a golf course.

In various embodiments, the modified golf game is to be played on existing golf courses or on other courses specifically designed and constructed or laid out for this game. In embodiments of the present invention, rules and regulations for a modified golf game are specified by the assignee under the tradename AeroGolf™.

A modified golf game is disclosed herein. In various embodiments, the game is played on a conventional golf course, where conventional golfers (using golf clubs) may share the golf course in the same party or on different holes. A hole in this modified golf game includes teeing off with an embodiment of an aerodynamic safety arrow, by loosing the arrow with their bow from the tee region. Subsequently, the golfer moves to where the arrow lands along the hole and proceeds to loose the arrow with their bow towards the green. In some embodiments, the number of times the golfer shoots her arrow, until the arrow hits a part of the green is his score for the hole. In other embodiments, the number of times the golfer shoots her arrow until it hits a specific part of the green is combined with a score reflecting a distance measurement to the pin/hole. In some examples, if the distance is greater than a first distance, a first number of "strokes" is added (e.g. 2), if the distance is less than the first distance, a second number of strokes is added (e.g. 1), etc. In still other embodiments, the number of times the golfer releases her arrow until it hits the green is combined with the number of actual putts the golfer takes to hit the ball in the hole.

According to one aspect of the invention, an aerodynamic safety arrow for a modified golf game to be played with a bow upon a conventional golf course is disclosed. One arrow includes a shaft, wherein a spine associated with the shaft is appropriate for a pull weight associated with the bow, and a safety arrowhead disposed upon the shaft, wherein the safety arrowhead comprises a blunt front-end region and a concave rear-end region, wherein the blunt front-end region comprises a radius of curvature less than about 20 mm, and wherein the concave rear-end region is coupled to the shaft. In some embodiments, the shaft and safety arrow head weigh less than about 45 g.

According to another aspect of the invention, a method of playing a game on a conventional golf hole having a tee region, a fairway region, and a green region having a target, is disclosed. A game may include shooting an arrow having an aerodynamic arrow head with a bow from the tee region or fairway region towards the green region until the arrow reaches the green region, and determining a number of times the arrow is shot on the hole until the arrow reaches the green region. In some embodiments, when the arrow reaches on the green region, a process includes determining an approximate distance between the arrow and the target, and determining a score for the golf hole in response to the number of times the arrow is shot on the hole and the approximate distance between the arrow and the target.

BRIEF DESCRIPTION OF THE DRAWINGS

In order to more fully understand the present invention, reference is made to the accompanying drawings. Understanding that these drawings are not to be considered limitations in the scope of the invention, the presently described embodiments and the presently understood best mode of the invention are described with additional detail through use of the accompanying drawings in which.

DETAILED DESCRIPTION

The present invention relates to golf. More specifically, the present invention relates to apparatus and methods for playing golf on a conventional golf course that brings new players to the course and are accepted for play by golf courses. To facilitate this goal, the inventors of the present invention have developed an arrow that can fly distances similar to golf balls, and that is safer than golf balls to other players on a golf course.

In various embodiments, the inventors believe that arrows used in the present modified golf game should have a distance potential at least on par with conventional golf balls (e.g. over 200 yards). With such a distance potential, a player may play along with conventional golfers in their foursome, and keep up. Additionally, the inventors believe that various embodiments of arrows should be adaptable for use on a wide range of bows (with different bow weights). This is to reduce the start-up costs of new players, among other factors.

These above considerations are balanced against the inventors' concerns for playability. More particularly, to reduce the chance for injury to other golfers on a golf course, in various embodiments, the inventors have engineered the weight of the arrows to be less than a conventional golf ball (e.g. less than about 46 g). Because of this, the kinetic energy of a golf ball hitting the ground at 220 yards will be greater than the kinetic energy of embodiments of the arrow hitting the ground at the same distance. Additionally, the inventors have designed the shape of the safety arrow head to be blunt such that it is virtually impossible to accidentally penetrate human skin. With a large, blunt shape, the safety arrow head provides a large impact area, so that the arrow impact force per square inch is reduced.

Figure 1:
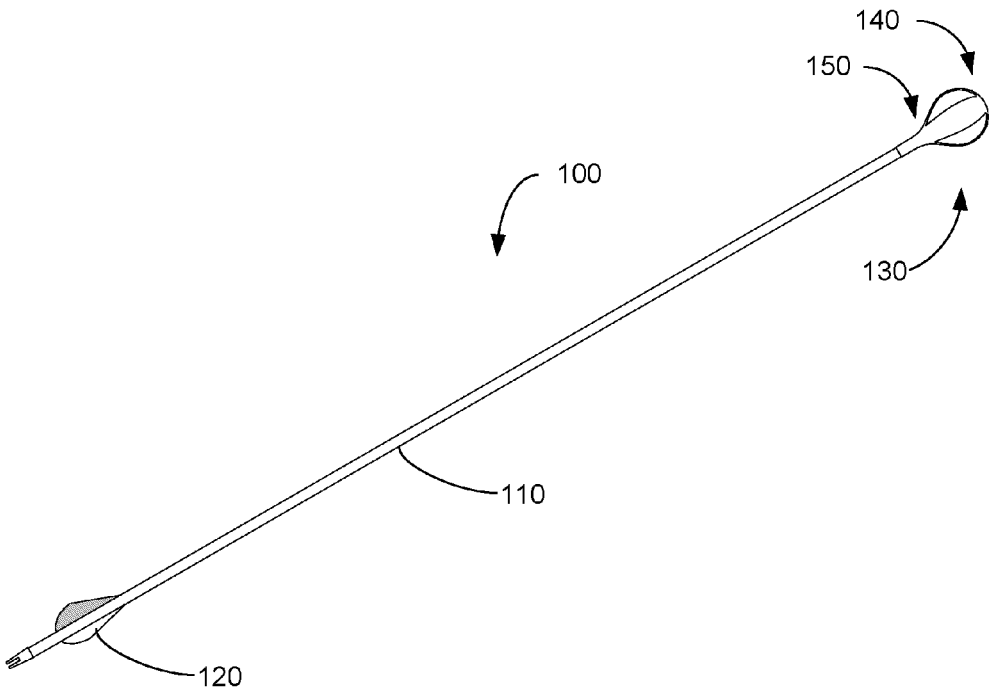
FIG. 1 illustrates an embodiment of an aerodynamic safety arrow according to various embodiments of the present invention.

FIG. 1 illustrates an embodiment of an aerodynamic safety arrow according to various embodiments of the present invention. As illustrated in FIG. 1, an aerodynamic safety arrow 100 includes a shaft portion 110, a fletching portion 120, and an aerodynamic safety arrow head 130. In various embodiments, arrow 100 has a weight within the range of about 30 grams to about 46 grams.

As discussed above, two of the inventors' competing considerations in selecting appropriate components for an aerodynamic safety arrow include: weight and adaptability.

In various embodiments, the inventors translate the adaptability factor to arrow stiffness, or arrow spine. More specifically, in various embodiments, the inventors consider arrows having a lower spine distance as being more adaptable to different bows than to arrows having a higher spine. For example, one arrow having a 1 inch spine may be adapted for use on bows within a range of about 20 lbs. to about 40 lbs., whereas another arrow having a 0.5 inch spine may be adapted for use on bows within a range of about 20 lbs. to about 60 lbs. In some specific embodiments, an arrow that has a high stiffness and can be used on bows within a range of 20 lbs. to about 75 lbs. In other embodiments, arrows may be designed for smaller ranges of bow strengths. For example, a first arrow may have a stiffness adapted for use on a bow within a range of about 20 lbs to about 40 lbs, a second arrow may have a stiffness adapted for use on a bow within a range of about 35 lbs to about 50 lbs, a third arrow may have a stiffness adapted for use on a bow within a range of about 50 lbs to about 75 lbs, or other ranges.

A competing consideration to stiffness is arrow weight. In various embodiments, the inventors recognize that arrow spine is often related to weight of shaft portion 110. For example, in the Easton XX75 Jazz arrow series, a first arrow has a spine of about 2.5" and a weight of about 10 grams, a second arrow has a spine of about 1.1" and a weight of about 15.5 grams, and a third arrow has a spine of about 0.53" and a weight of about 22.0 grams. As can be seen, spine distance and weight are typically inversely related. In one specific embodiment of the present invention, shaft portion 110 is an Easton X2315 arrow shaft having a spine of 0.34" and a weight of about 25 grams. Accordingly, such an embodiment is suitable for 25 lb. bows all the way up to 75 lb. bows. In other embodiments, different arrow shafts may be selected having lower weights and may be adapted to smaller ranges of bows. In some embodiments, arrow shafts may be made of any material, such as metal, carbon fiber, plastic, wood, fiber glass, or the like. In other embodiments, the arrow shafts may float on water.

In various embodiments, a fletching portion 120 may include any number of conventional plastic or feather fins. In some cases three or more fins may be used, and in some cases fewer than three fins (e.g. zero) may also be used. In various embodiments the fletching may be oriented in a straight, offset (spiral), helical, or other configuration. In other embodiments, non-conventional fletching such as FOB may be used.

FIG. 1 also illustrates an aerodynamic safety arrow head 130 according to various embodiments of the present invention. In this example, arrow head 130 generally includes a blunt head portion 140 and a curved and convex portion 150. As can be seen, portion 150 is coupled to shaft portion 110 nearer to the convex portion.

In various embodiments, the inventors also balance various performance considerations in determining the shape of arrow head 130. Some considerations include the weight of arrow head 130, the shape of arrow head 130, the drag of arrow head 130, energy absorbing capability of arrow head 130, and the like. Numerous embodiments of arrow head 130 are disclosed further in the figures and description below.

Figure 2:
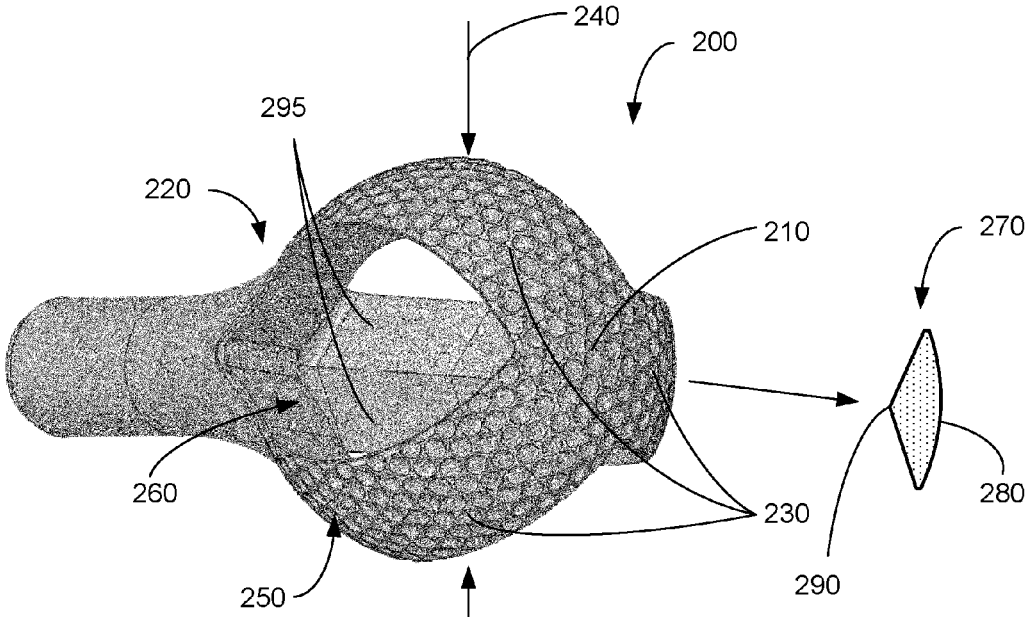
FIG. 2 illustrates a close-up view of one embodiment of the present invention.

FIG. 2 illustrates a close-up view of one embodiment of the present invention. In this example, a hollowed-out ball-shape arrow head 200 is illustrated. In this example, arrow head 200 includes a blunt end portion 210, a concave portion 220, and three legs 230. In this example, legs 230 intersect at blunt end portion 210 and again near concave portion 220. As shown, legs 230 may include a series of structures 250 that may further help reduce aerodynamic drag. In other embodiments, other arrangements of dimples, or other shapes are contemplated that may increase or decrease aerodynamic drag. A different number of legs 230 may be used, such as two, three, four, five, or the like.

In various embodiments, legs 230 help define an arrow head having an external semicircular or ball-shaped or a head with a reduced number of sharp edges, e.g. a geodesic dome. The inventors believe that a wide-diameter 240 arrow head 200 is typically associated with greater air resistance and thus such an arrow would have a shorter flight distance. However, such a wide-diameter arrow head 200 would have a bigger impact area and thus such an arrow would hurt a person or the ground less. Because arrows typically cannot hook, slice, or be affected by the wind as much as a conventional golf ball, the inventors believe that the chance of unintentionally hitting another golfer with an aerodynamic safety arrow is lower than with a golf ball. Accordingly, in various embodiments, arrow heads 200 have a cross-sectional diameter (e.g. about 34 mm) that is smaller than a cross-sectional diameter of a typical golf ball (e.g. 42.7 mm). To further reduce air resistance, as illustrated in FIG. 2, the cross-section area is further reduced in the regions between legs 230.

In various embodiments, the material of arrow head 200 is relatively flexible. Accordingly, if an arrow were to strike a hard object (e.g. person, tree, the ground), energy is dissipated by legs 230 bending, and an interior cavity 260 temporarily decreasing in volume. In FIG. 2, diagram 270 illustrates a cross-section of one of the three legs 230.

Similar to the embodiments shown in FIG. 3E, below, a top surface 280 is curved. Additionally, a bottom surface 290 is formed of intersecting surfaces 295.

In some embodiments, arrow head 200 may include a central support extending from the arrow shaft until the blunt end portion 210. The central support may be used to hold an internal weight. The internal weight may be formed of metal or other dense material and can be added to modify the arrow front of center (center of gravity). In one embodiment, the FOC is approximately 18.33, although this may vary according to desired performance characteristics. In some embodiments, arrow head 200 may have a total weight on the order of about 6 grams to about 17 grams.

FIGS. 3A-F illustrate additional examples of an aerodynamic safety arrow head according to embodiments of the present invention. In some embodiments, the arrow head may be constructed from open or closed cell foam, hard or soft plastics, hard or soft rubber, light weight and/or flexible metal (e.g. aluminum, titanium), wood, carbon fiber, fiber glass, or other materials. The arrow head may be composed of one or more materials, such as a soft foam interior and a hard rubber exterior, or the like.

Figure 3A:
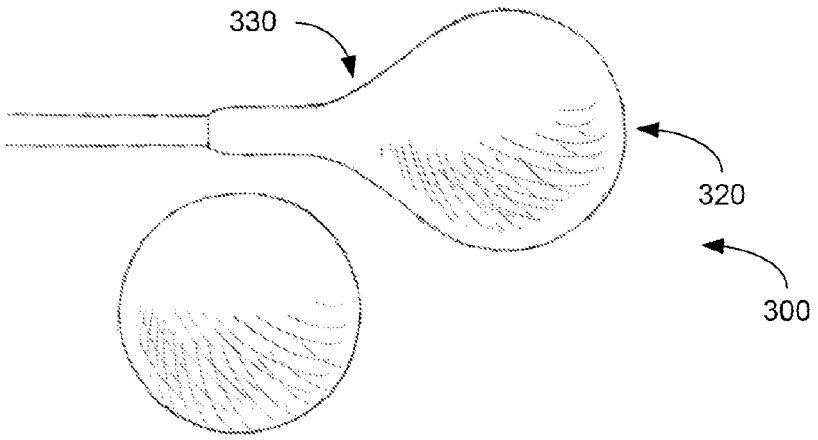
FIGS. 3A-F illustrate additional examples of an aerodynamic safety arrow head according to embodiments of the present invention.

In the example in FIG. 3A, a front and side view of an arrow head 300 is illustrated. In this example, arrow head 300 has a solid surface without cut-outs or vents. In various embodiments, arrow head 300 may include an external shell and may be have a hollow interior or a filled interior. For example, an external shell may be a relatively flexible plastic or rubber coating, and a closed or open cell foam may fill the interior region.

As can be seen in FIG. 3A, and in many of the embodiments herein, arrow head 300 generally has a blunt-nose region 320, and a concave region 330. As will be discussed below, the inventors have developed such "teardrop" designs to reduce the expected aerodynamic drag of the arrow head 300.

Figure 3B:
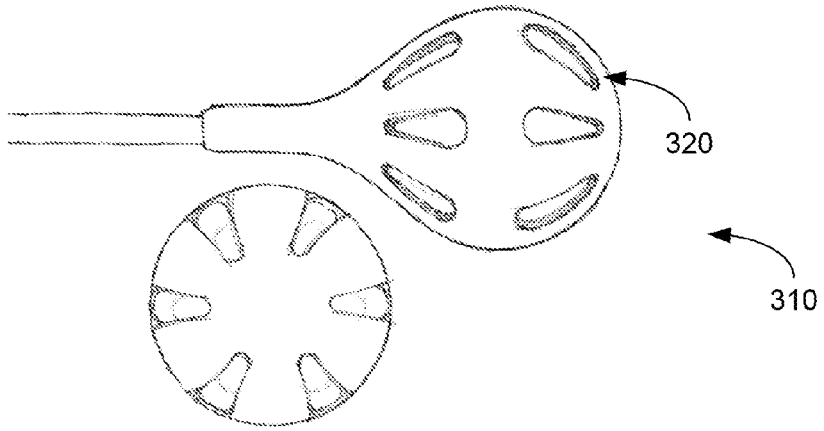

In the example in FIG. 3B, a front and side view of an arrow head 310 is illustrated. In this embodiment, arrow head 310 may have an exterior "teardrop" shell with one or more cut-out regions 325. In various embodiments, arrow head 310 may be hollow or filled with material. As can be seen in this and subsequent examples, the shape, the sizes, the locations, etc. of cut-out regions 325 can be changed. The inventors believe that different combinations of such cut-outs yield different performance characteristics that may be desired in alternative embodiments. As an example, some arrow heads may have cut-out regions on only one a left or right half of the arrow head. Accordingly, such arrow heads may enable the player to deliberately bend the flight of the arrow to the left, right, or the like.

Figure 3C:
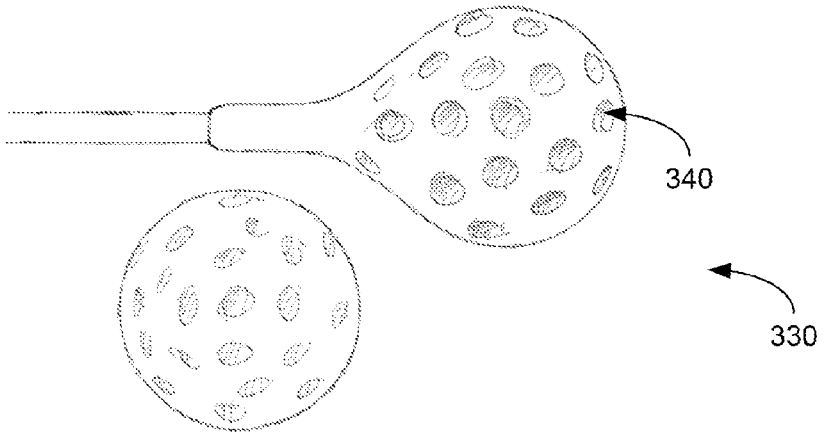

In the example in FIG. 3C, a front and side view of an arrow head 330 is illustrated. In this embodiment, arrow head 330 may also have an exterior shell with dimples 340. The shapes and packing of the shapes upon arrow head 330 may be different, based upon specific requirements. In various embodiments, arrow head 330 may be hollow or filled with different material from an exterior shell.

Figure 3D:
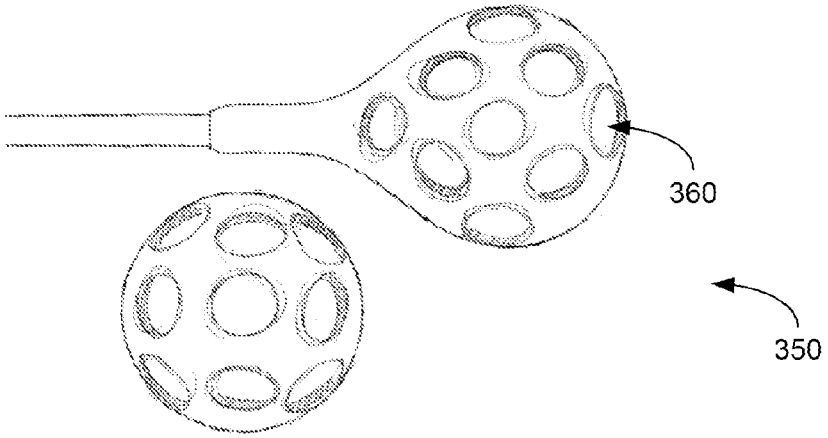

In the example in FIG. 3D, a front and side view of an arrow head 350 is illustrated. In this embodiment, arrow head 350 may also have an exterior shell with one or more cut-out regions 360. In various embodiments, arrow head 350 may also be hollow or filled with different material from an exterior shell.

Figure 3E:
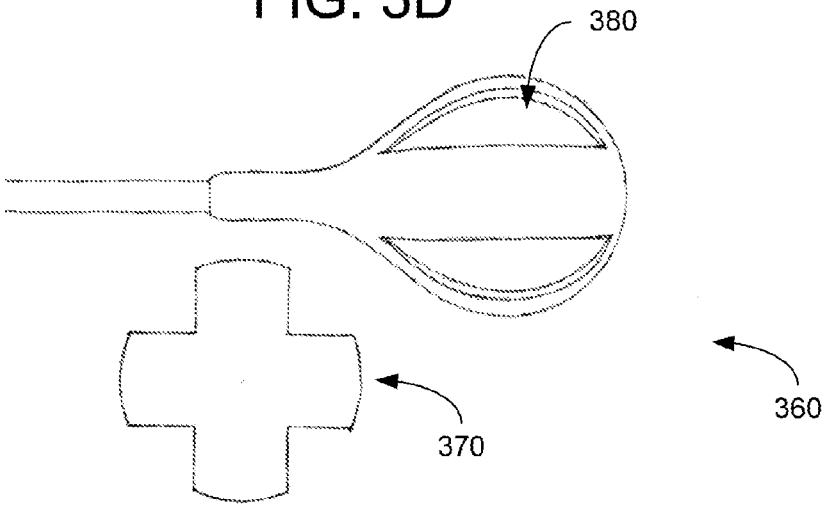

In the example in FIG. 3E, a front and side view of an arrow head 360 is illustrated. In this embodiment, arrow head 360 may be similar to design to arrow head 200 in FIG. 2 in that multiple legs 370 help define a vented interior region 380. As can be seen, the number of legs 370 can vary compared to arrow head 200. In various embodiments, any number of legs 370 may be used, such as from two, three, four, five, etc. In various embodiments, interior region 380 may be hollow or filled with different material (e.g. closed-cell foam), which can vary the weight and air resistance of arrow head 360.

Figure 3F:
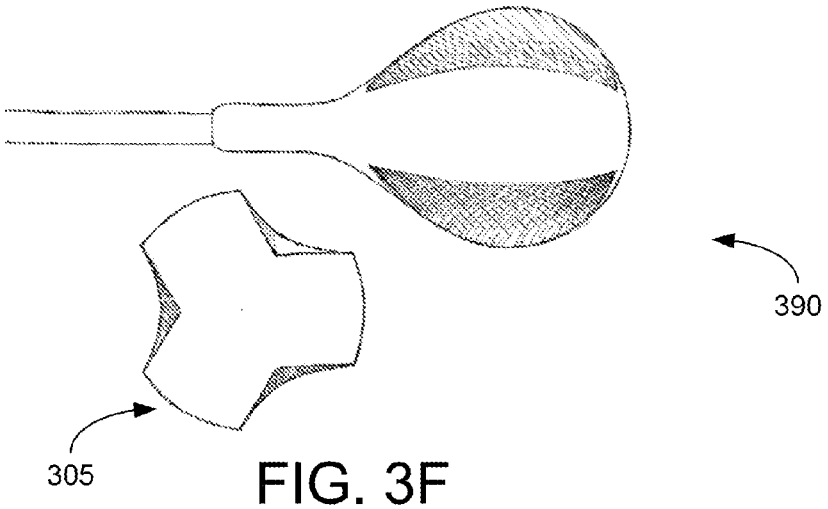

In the example in FIG. 3F, a front and side view of an arrow head 390 is illustrated. In this embodiment, arrow head 390 may have a continuous exterior shell without having cut-out regions. In various embodiments, arrow head 390 may be hollow or filled with different material from the continuous exterior shell. Additionally, in various embodiments, the number of vanes 305 may be different. For example the number of vanes may be two, three, four, five, or the like. Similar to the examples in FIGS. 2 and 3E, the vanes or legs may run approximately parallel to the axis of an arrow.

Figure 4A:
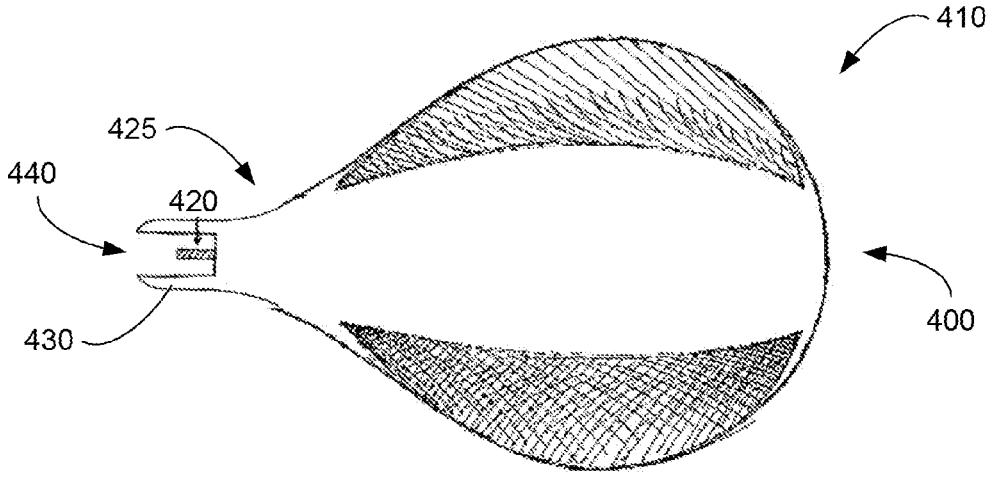
FIGS. 4A-B illustrate various embodiments of the present invention.
Figure 4B:
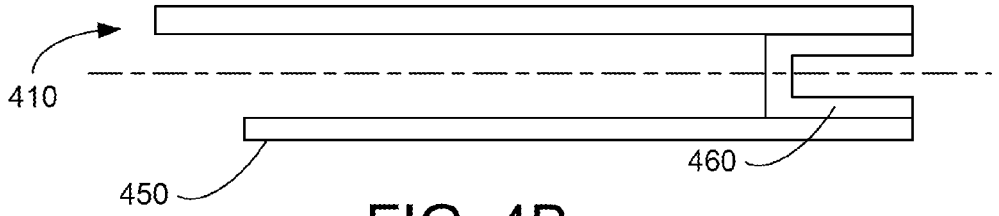

FIGS. 4A-B illustrate various embodiments of the present invention. More specifically, FIGS. 4A-B illustrate a mechanism for attaching an arrow head 400 onto an arrow shaft 410. In FIG. 4A, an arrow head 400 includes a blunt front end 410 and a concave portion 425, as was discussed above. In this embodiment, arrow head 400 also includes a flange support portion 430 surrounding a cavity 440. The cavity 440 is adapted to have arrow shaft 410 fitted therein and flange portion 430 helps arrow shaft 410 maintain axial alignment between arrow head 400 and arrow shaft 410.

In the example illustrated in FIG. 4A, a protrusion 420 is provided within cavity 440. Protrusion 420 may be embodied as a threaded screw, an alignment pin, a textured protrusion, or the like. In various embodiments, protrusion 420 may be made of metal, rigid plastic, or the like.

FIG. 4B illustrates an end portion of arrow shaft 410. In this example, arrow shaft 410 includes a body portion 450 with an inset portion 460. In various embodiments inset portion 460 is adapted for coupling with protrusion 420. In the case where protrusion 420 comprises a threaded screw, inset portion 460 may be a threaded collar, or the like. In other embodiments, inset portion 460 may have a plain or textured interior wall.

Figure 5:
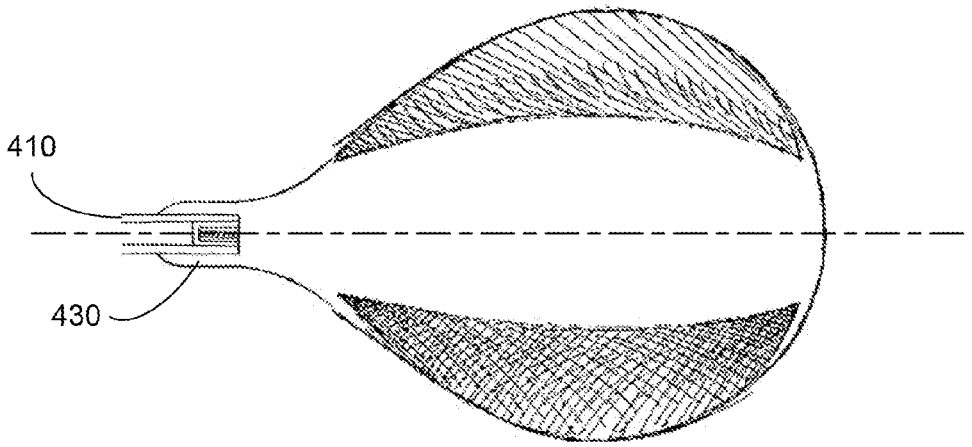
FIG. 5 illustrates an embodiment of the present invention.

FIG. 5 illustrates an embodiment of the present invention. More specifically, FIG. 5 illustrates the attachment between arrow shaft 410 and arrow head 400. In one example where protrusion 420 is a threaded screw, protrusion 420 screws into inset portion 460. One or more lock material may be disposed upon protrusion 420 or inset portion 460 so as to make subsequent unscrewing of arrow head 400 from arrow shaft 410 more difficult. In embodiments of protrusion 420 other than screws, protrusion 420 may be inserted or force fit into inset portion 460. Additionally, glues, epoxies, or other compounds may be used to retain arrow head 400 onto arrow shaft 410.

As also shown in FIG. 5, flange portion 430 helps maintain axial alignment of arrow head 400 relative to arrow shaft 410. As embodiments of the present invention are designed to be used on a golf course and strike the ground repeatedly, the inventors believe that flange portion 430 greatly helps with durability of an aerodynamic safety arrow.

Figure 6:
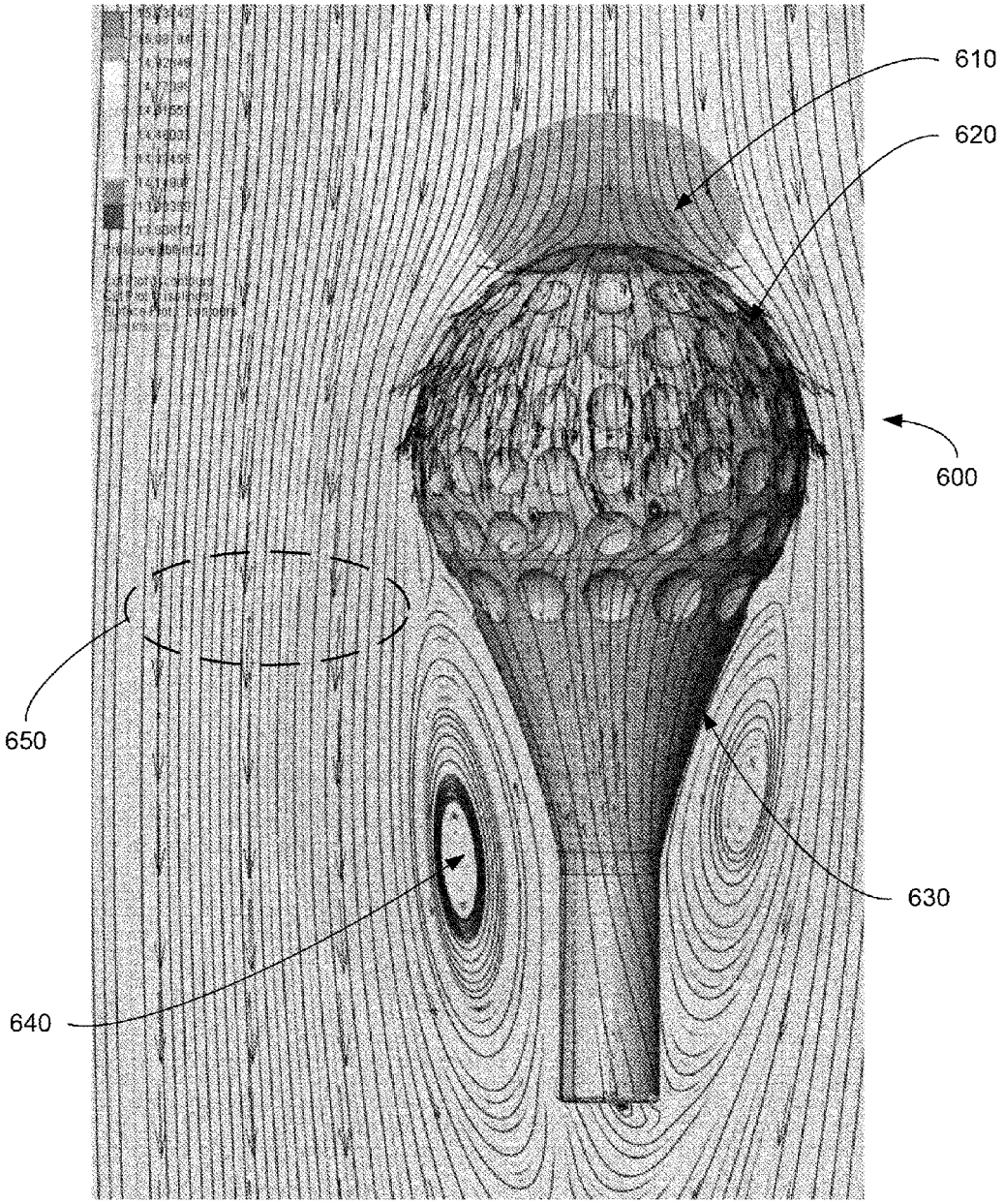
FIG. 6 illustrates an analysis performed according to embodiments of the present invention.

FIG. 6 illustrates an analysis performed according to embodiments of the present invention. More specifically, FIG. 6 illustrates a computer simulation of the aerodynamics of a safety arrow described herein.

As illustrated in FIG. 6, a safety arrow 600 includes a blunt nose portion 610, a number of surface structures 620, and concave rear portions 630. Based upon the air flow analysis, the inventors identify a number of counter-rotating vortices 640 that are formed or induced as a result of concave rear portions 630. It is believed that these counter-rotating vortices 640 help create a slip stream 650 around the arrow head that reduces parasitic drag. More specifically, instead of creating an air vacuum behind blunt nose portion 610 and creating a drag, it is believed that vortices 640 reduce the perturbation of air as it passes by the arrow head.

In practice, embodiment of the present invention travel much farther than what the inventors initially hoped their safety arrows would travel. Additionally, in surprising contrast to conventional arrows that tend to flip or stall-out when shot at long distances, embodiments of the present invention maintain a highly parabolic curve when playing the modified golf game.

Figure 7A:
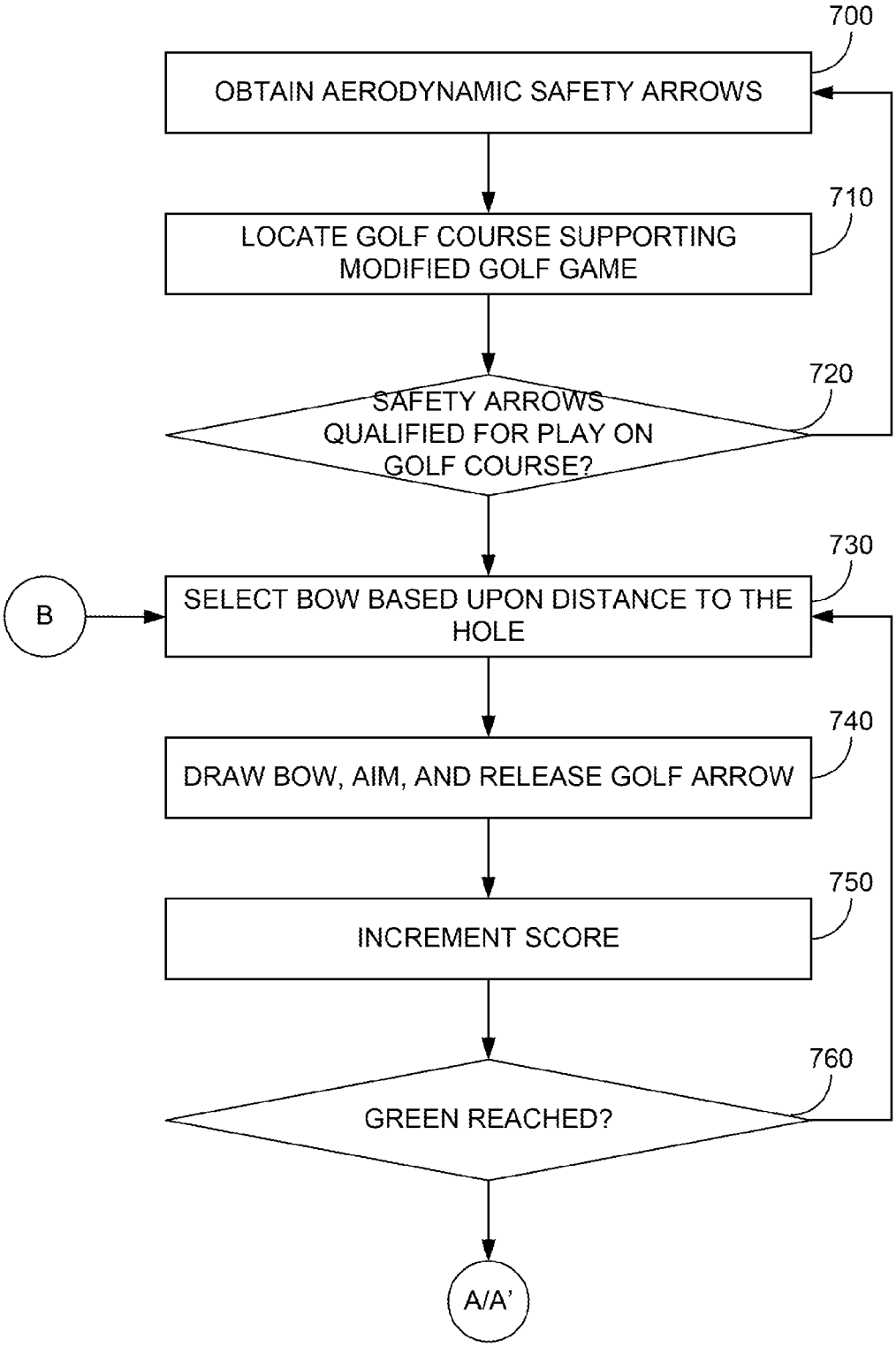
FIGS. 7A-C illustrate a flow diagram of a modified golf game according to various embodiments of the present invention.
Figure 7B:
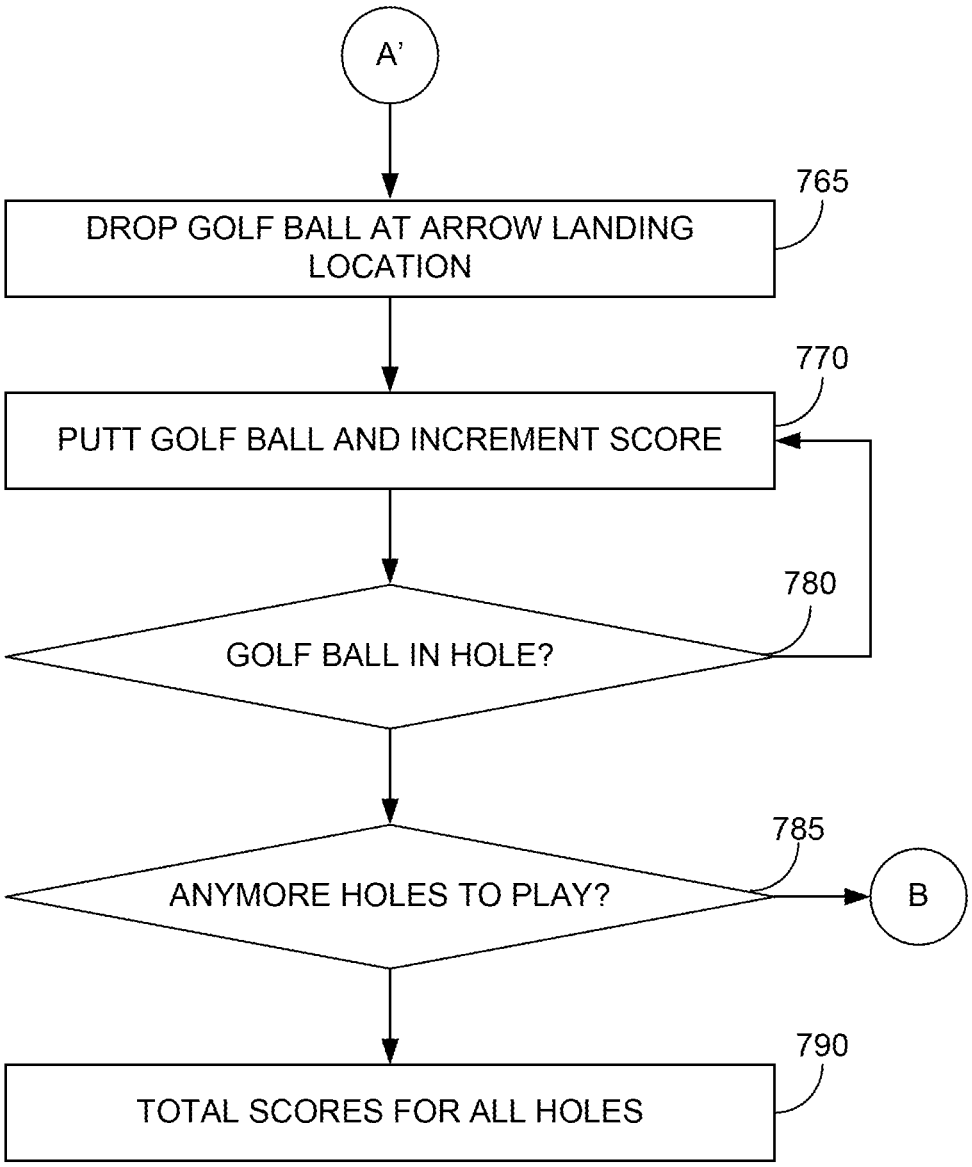
Figure 7C:
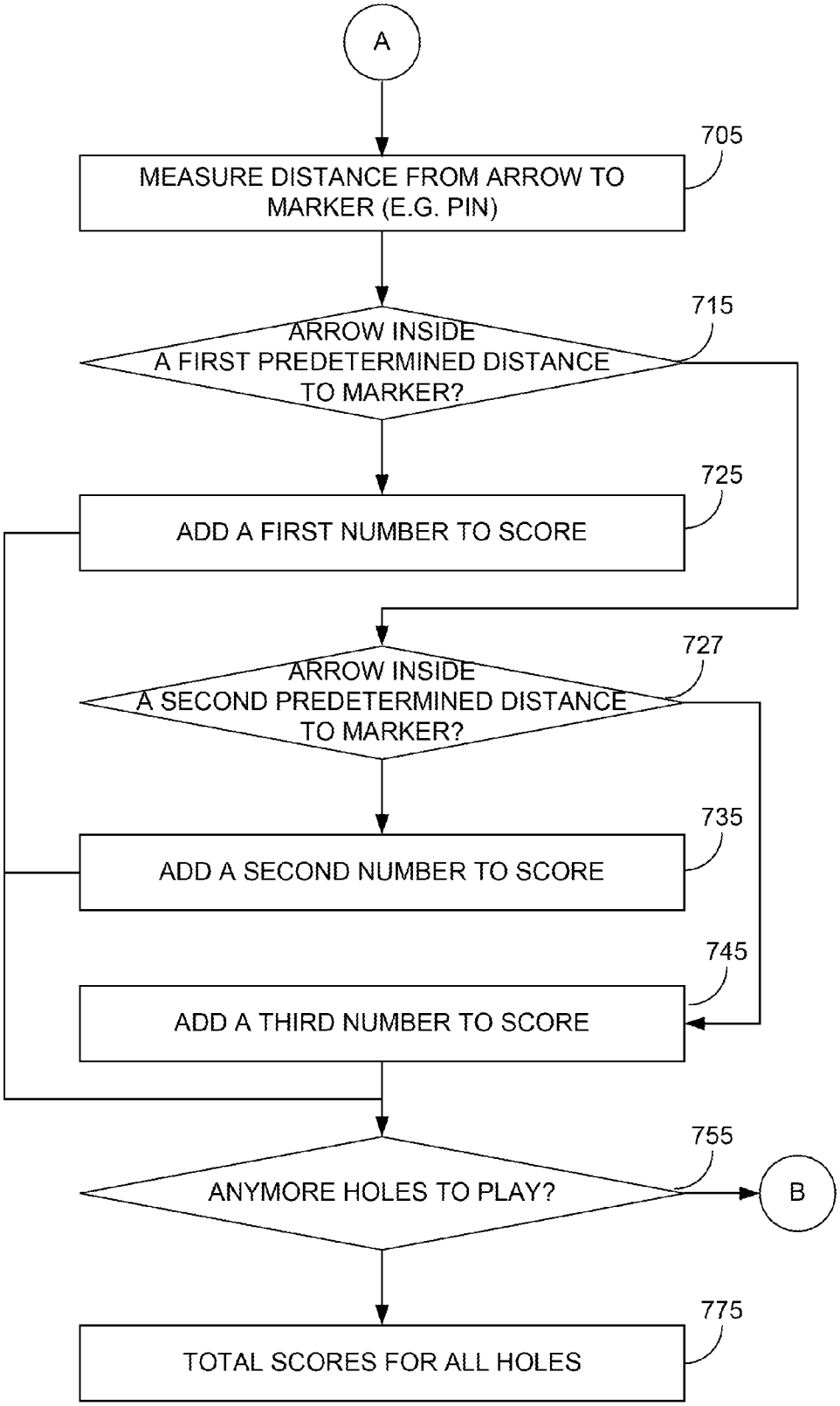

FIGS. 7A-C illustrate a flow diagram of a modified golf game according to various embodiments of the present invention.

Initially, a user or a golf course obtains aerodynamic safety arrows, step 700. In various embodiments, it is believed that embodiments of the safety arrows described above, provide surprising levels of safety and performance.

Next, a user locates a golf course that is certified and/or for modified golf, step 710. As seen firsthand by the inventors of the present invention, there is great resistance by traditional golf courses in general to new ideas. However, with the introduction of the herein described aerodynamic safety arrow, the inventors have proven to traditional golf courses that modified golf is actually much safer to other golfers on a golf course and less damaging to the fairways and greens than ordinary golf balls. Some golf courses have reported that their insurance companies do not require any additional insurance to support modified golf, so long as safety arrows, as disclosed herein are used for modified golf. Accordingly, it is contemplated that approved safety arrows and possibly other equipment, will be required by golf courses, step 720.

In various embodiments, it is contemplated that to play modified golf, a player need a minimum of one bow to play modified golf. However, in alternative embodiments, a player may have one bow for long range shots, e.g. +200 yards, and a lower bow weight for shorter range shots, e.g. 50 yards. In various embodiments, the player selects a bow appropriate for the shot, step 730.

Next, a user loads the bow with the safety arrow, draws the bow, aims, and releases the safety arrow, step 740. In various embodiments, unless there is a special condition, e.g. the arrow touching the hole, the player's score is increased by one stroke/shot, step 750.

In various embodiments, when the green is reached, step 760, there are different ways to continue the modified golf game, as illustrated in FIGS. 7B and C. In the embodiment illustrated in FIG. 7B, initially the player drops a conventional golf ball where the head of the safety arrow touches the green, step 765. Next, the player putts the golf ball towards the hole, step 770. In various embodiments, the player's score is also incremented. The process typically repeats, if necessary, until the golf ball is in the hole, step 780. If there additional holes to play, step 785, the game continues to step 730. Otherwise, the player's score is the sum of strokes/shots, step 790.

The embodiment illustrated in FIG. 7C shows an alternative method of playing the modified golf game when the safety arrow reaches the green. In this example, a distance measurement may be made from the head of the safety arrow to a reference point, step 705. In various embodiments, the reference point may be from a center point on the green, the hole, a marker, or the like. In the present example, if the safety arrow is within a first distance (e.g. 4 feet) to the reference point (e.g. hole), step 715, one stroke/shot, for example, is added to the player's score, step 725; otherwise if the safety arrow is within a second distance (e.g. 8 feet) to the reference point (e.g. a green marker), step 727, two strokes/shots, for example, are added to the player's score, step 735; otherwise, three strokes/shots, for example, are added to the player's score, step 745.

If there additional holes to play, step 755, the game continues to step 730. Otherwise, the player's score is the sum of strokes/shots, step 775. In various embodiments, the decision whether to putt or to use the virtual target of FIG. 7C for scoring purposes may be done once per round or on a hole by hole basis.

Figure 8:
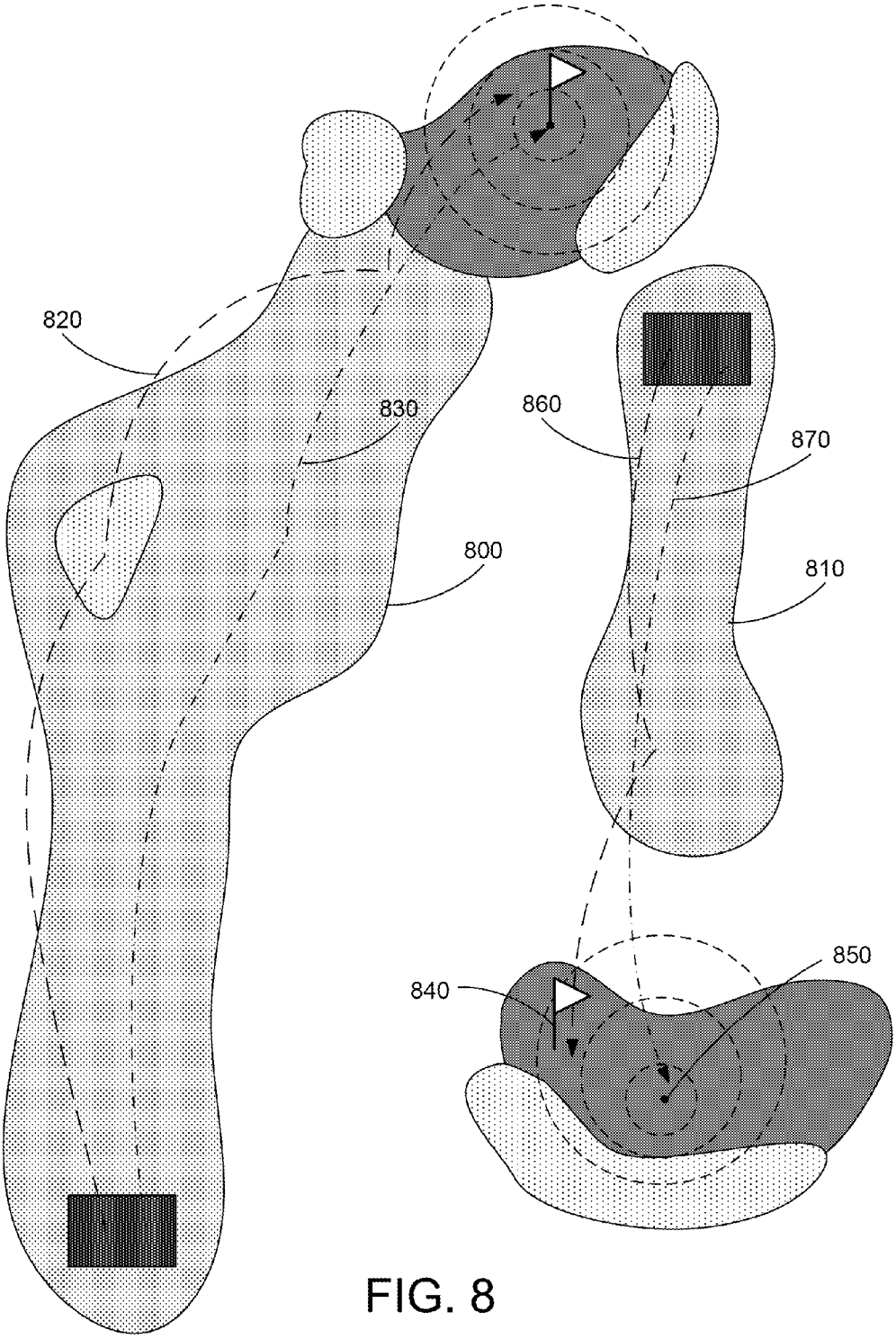
FIG. 8 illustrates examples according to various embodiments of the present invention.

FIG. 8 illustrates examples according to various embodiments of the present invention. In FIG. 8 two holes 800 and 810 of a conventional golf course are shown. With respect to hole 800, two players shots/strokes are illustrated by paths 820 and 830. For the first player, following path 820, the player reaches the green in three strokes; has a one stroke penalty for hitting a bunker; and is assessed two strokes for hitting the second ring around the hole. The first player thus has six strokes for hole 800. For the second player, following path 830, the player reaches the green in two strokes; is assessed one stroke for hitting the first ring around the hole; and (in this example) because the safety arrow overlies the hole, has one stroke taken away from her score. This is termed, "The Goose," within some embodiments. The second player thus has two strokes for hole 800.

With respect to hole 810, several differences can be seen. In particular, instead of shooting for the pin 840, for this hole, the players aim for a marker or spot 850 approximately in the middle of the green. Additionally, the scoring distances need not be concentric about marker 850. Using a GPS unit, the location a player's arrow lands on the green can be electronically marked by a player, and the number of strokes to add to a player's score can be electronically determined. Accordingly, the scoring zones need not be regular in shape, and the player need not physical measure the distance to the target with a tape measurer.

With respect to hole 810, two player shots/strokes are illustrated by paths 860 and 870. For the first layer, following path 860, the player reaches the green in two strokes, coming very close to the pin. However, the player shot for the wrong target, and is assessed three strokes for falling within the third ring around marker 850. The first player thus has five strokes for hole 810. For the second player, following path 870, the player reaches the green in one stroke; and (in this example) because the safety arrow overlies the marker, has one stroke taken away from her score (the goose). The second player thus has zero strokes for hole 810, or a "Hole in None."

In other embodiments, other types of scoring bonuses (negative strokes) or penalties (positive strokes) may be added. In one example, termed "The Condor", if the player uses a 40 lb. bow or above and releases an arrow that lands on the green from 150 yards away, one stroke may be taken away; and if the player uses a bow under 40 lbs. and releases an arrow that lands on the green from 75 yards away, one stroke may also be taken away. Different combinations of the above may also be provided. As an example, if a player shoots a "Condor" and a "Goose" with one shot, the player has negative one stroke for the hole.

In various embodiments for two equally skilled players, more than likely player one with the higher bow weight will likely beat player two. Accordingly, the inventors have developed a handicapping system that attempts to reduce the effect of the higher bow weight on the players' scores. In one example, for the following formula is used for player 1 (the player with the stronger bow):

$$P1'=((P1-P2)/(P1W/P2W))+P1$$

In this equation, P1 and P2 are the number of strokes for player 1 and player 2, respectively; P1W and P2W are the bow weights for player 1 and player 2, respectively; and P1' is the adjusted score for player 1. As an example of this, suppose P1=76 strokes; P1W=60 lbs.; P2=86 strokes; and P2W=30 lbs. Using this example, P1'=81 strokes ((86−76)/(60/30)+76). Using such a handicap, player 1's adjusted score is 81 strokes, and player 1 still beats player 2, who has 86 strokes. In other embodiments, different mechanisms for handicapping are contemplated.

In other embodiments, combinations or sub-combinations of the above disclosed invention can be advantageously made. For example, in other embodiments of the present invention, an arrow head itself may have a series of vanes (e.g. FIG. 3F) that are offset/helical twist relative to the axis of the arrow, or the like. When such embodiments are used, it is believed that that a spin may be imparted to the arrow because of the vanes. The spin may give the arrow additional stability and/or distance. In some embodiments, a wide range of colors and graphic designs are contemplated, for the sake of visibility and style. Additionally, in some embodiments, aerodynamic safety arrows may include internal lighting sources (and batteries), such as LEDs. The LEDs may be embedded into the arrow heads, arrow heads, and/or the nocks of the arrow. Other combinations of lighting are also contemplated for the purpose of visibility in low light conditions. Embodiments of such arrows are planned to be available under the trademark "Night AeroGolf™" by the assignees of the present invention.

In other embodiments, different types of games may be played using embodiments of the aerodynamic safety arrows. The block diagrams of the architecture and flow charts are grouped for ease of understanding. However it should be understood that combinations of blocks, additions of new blocks, re-arrangement of blocks, and the like are contemplated in alternative embodiments of the present invention.

The specification and drawings are, accordingly, to be regarded in an illustrative rather than a restrictive sense. It will, however, be evident that various modifications and changes may be made thereunto without departing from the broader spirit and scope of the invention as set forth in the claims.

What is claimed is:

1. An aerodynamic safety arrow for a modified golf game to be played with a bow upon a conventional golf course comprising:

a shaft, wherein a spine associated with the shaft is appropriate for a pull weight associated with the bow, wherein the shaft includes a first end and a second end, wherein the first end includes a nock and fletching;

a safety arrowhead disposed upon the shaft, wherein the safety arrowhead comprises:

a cylindrical-shaped portion having a cylindrical-shaped internal cavity;

a plurality of legs and a blunt front-end region;

wherein the second end of the shaft is disposed within the cylindrical-shaped internal cavity;

wherein a first portion of each leg from the plurality of legs intersect the blunt front-end region;

wherein a second portion of each leg from the plurality of legs intersect the cylindrical-shaped portion;

wherein the second portion of each leg from the plurality of legs extend radially outwards from the cylindrical-shaped portion towards the blunt front end region;

wherein each leg from the plurality of legs are separate from each other and partially define an ovoid-like internal cavity, wherein the blunt front-end is coupled to the shaft only via the plurality of legs, and wherein the blunt front-end region comprises a radius of curvature less than about 20 mm; and wherein the shaft and safety arrow head weigh less than about 45 g.

2. The aerodynamic safety arrow of claim 1 wherein the shaft and safety arrow head weigh less than about 30 g.

3. The aerodynamic safety arrow of claim 1 wherein the second end of the shaft is removably disposed within the safety arrow head.

4. The aerodynamic safety arrow of claim 1 wherein the second end of the shaft is screwed into the cylindrical-shaped internal cavity.

5. The aerodynamic safety arrow of claim 1 wherein an external surface for each leg of the plurality of legs comprises a plurality of dimples arranged in a triangular geometric lattice.

6. The aerodynamic safety arrow of claim 1 wherein each leg from the plurality of legs comprises a cross-section having a top surface and a bottom surface;

wherein bottom surfaces of the plurality of legs form walls of the ovoid-like internal cavity;

wherein top surfaces of the plurality of legs are curved.

7. The aerodynamic safety arrow of claim 6 wherein the bottom surfaces of the plurality of legs comprise intersecting surfaces.

8. The aerodynamic safety arrow of claim 6 wherein the aerodynamic safety arrow is associated with a front of center (FOC) center of gravity of approximately 18.33.

9. The aerodynamic safety arrow of claim 1 wherein a number of the plurality of legs is selected from a group consisting of: three, four, five, six.

10. The aerodynamic safety arrow of claim 1 wherein the safety arrow head comprises a material selected from a group consisting of: metal, plastic, foam, wood, and carbon fiber.

11. The aerodynamic safety arrow of claim 1 wherein the shaft comprises a material selected from a group consisting of: metal, plastic, foam, wood, and carbon fiber.

12. The aerodynamic safety arrow of claim 1 wherein the safety arrow head comprises a front view having approximately a + shape.

13. The aerodynamic safety arrow of claim 1 wherein the safety arrow head comprises a front view having approximately a y shape.

14. The aerodynamic safety arrow of claim 1 wherein a diameter of a cross-section of the safety arrowhead is within a range of about 34 mm to about 42 mm.

15. A method of playing a game on a conventional golf hole having a tee region, a fairway region, and a green region having a pin comprising:

loosing an arrow having an aerodynamic arrow head with a bow from the tee region or fairway region towards the green region until the arrow reaches the green region;

determining a number of times the arrow is loosed on the golf hole until the arrow lands on the green region;

after the arrow lands on the green region, determining an approximate distance between the arrow and the pin;

determining a score for the golf hole in response to the number of times the arrow is loosed on the golf hole and the approximate distance between the arrow and the pin.

16. The method of claim 15 wherein determining the score for the golf hole further comprises:

determining a target number in response to the approximate distance between the arrow and the pin; and determining the score for the golf hole by adding the number of times the arrow is loosed on the golf hole and the target number.

17. The method of claim 16 wherein determining a target number comprises:

setting the target number to a first number when the approximate distance between the arrow and the pin exceeds a first distance; and setting the target number to a second number when the approximate distance between the arrow and the pin does not exceed the first distance;

wherein the first number exceeds the second number.

18. The method of claim 15 wherein loosing the arrow having the aerodynamic arrow head with the bow comprises:

loosing the arrow from the tee region to the fairway region; and loosing the arrow from the fairway region towards the green region until the arrow reaches the green region.

19. The method of claim 15 wherein loosing the arrow having the aerodynamic arrow head with the bow comprises loosing the arrow from the tee region and reaching the green region; and wherein the number of times the arrow is loosed is one.

20. The method of claim 19:

wherein the approximate distance between the arrow and the pin is zero;

wherein determining the score for the golf hole is in response to the number of times the arrow is loosed on the golf hole and a bonus number; and wherein the bonus number is negative.

21. The method of claim 20 wherein determining the score for the golf hole in response to the number of times the arrow is loosed on the golf hole, the approximate distance between the arrow and the pin and a bonus number; and wherein the bonus number is determined in response to a draw weight associated with the bow.

* * * * *